United States Patent [19]

Kopp

[11] 4,306,800

[45] Dec. 22, 1981

[54] APPARATUS FOR CONTROLLING THE POSITION OF A RECORDING CARRIER AND TRANSPORT THEREOF RELATIVE TO AN INTERMEDIATE CARRIER OF A PRINTING OR COPYING DEVICES

[75] Inventor: Walter Kopp, Taufkirchen, Fed. Rep. of Germany

[73] Assignee: Siemens Aktiengesellschaft, Berlin & Munich, Fed. Rep. of Germany

[21] Appl. No.: 112,203

[22] Filed: Jan. 15, 1980

[30] Foreign Application Priority Data

Jan. 29, 1979 [DE] Fed. Rep. of Germany ..... 2903265

[51] Int. Cl.[3] ..... G03G 15/00

[52] U.S. Cl. ..... 355/3 TR; 355/14 R

[58] Field of Search ..... 355/3 TR, 3 SH, 3 R, 355/14 SH, 16, 3 TE, 14 R; 101/228; 226/74

[56] References Cited

U.S. PATENT DOCUMENTS

| | | | |
|---|---|---|---|
| 3,893,760 | 7/1975 | Thettu | 355/3 TR |
| 4,131,358 | 12/1978 | Windele | 355/3 TR |
| 4,213,551 | 7/1980 | Windele | 355/3 TR |

FOREIGN PATENT DOCUMENTS

| | | | |
|---|---|---|---|
| 54-1036 | 1/1979 | Japan | 355/3 TR |

*Primary Examiner*—Richard L. Moses

*Attorney, Agent, or Firm*—Hill, Van Santen, Steadman, Chiara & Simpson

[57] ABSTRACT

Apparatus for printing of toner images wherein characters to be printed are produced on an intermediate carrier (ZT); for example, a photoconductive drum and transferred at a printing station (US) onto a recording carrier (AT) with continuous movement of the recording carrier. In order to start and stop the movement of the recording carrier there is provided, behind the printing station, a feed means (VR) engaging the recording carrier (AT) which has a drive shaft (VRW) of a drive installation with an electromagnetic coupling (EMK) and an electromagnetic brake (EMB). In order to be able to swing the recording carrier (AT) to the intermediate carrier (ZT) and to swing it away, respectively, a polarized drawing magnet (HM) is provided at the printing station. During starting of the recording carrier the feed means (VR) are first set into motion by the electromagnetic coupling (EMK) and upon reaching the nominal speed the drawing magnet (HM) is energized so that it swings the recording carrier to the intermediate carrier (ZT). During braking of the recording carrier the drawing magnet is first activated so that it swings the recording carrier away from the intermediate carrier (ZT). Subsequently, the electromagnetic brake (EMT) is actuated and thus the feed means (VR) are brought to a standstill.

9 Claims, 5 Drawing Figures

APPARATUS FOR CONTROLLING THE POSITION OF A RECORDING CARRIER AND TRANSPORT THEREOF RELATIVE TO AN INTERMEDIATE CARRIER OF A PRINTING OR COPYING DEVICES

BACKGROUND OF THE INVENTION

The invention relates to an apparatus for transporting a recording carrier through a printing station and for moving the recording carrier toward or away from an intermediate carrier at such station of a printing or copying apparatus in which toner images, arranged on the intermediate carrier, of the characters to be printed, are transferred to the recording carrier.

It is known that the paper web which is to receive printed material in the printing station of a mechanical highspeed printer, must be precisely transported through the printing location in order to obtain a clear legible print, and to achieve these results, corresponding paper guides for the paper, forming the recording carrier, are provided. A similar problem also arises in the operation of non-mechanical printing devices, as for example those employing electrostatic printing. Such electrostatic high-speed printers may involve, for example, an electrophotographic high-speed printer mechanism in which the printing information is projected in a light-optical fashion on a photoconductive surface, for example, a drum which is electrostatically charged throughout its entire area. The latent charge-image of the desired information to be printed, produced by such an arrangement, is developed in a developer station with colored powder, normally designated by the term "toner". The image so developed with powder is then transferred in a printing station from the electrostatically charged drum to a recording carrier, such as a paper web, by means of an influencing electrostatic field.

To achieve a satisfactory transfer of the powder image from the photoconductive surface of such intermediate carrier to the paper web, hereafter referred to as the "recording carrier", the latter must be brought into suitable predetermined relationship with the intermediate carrier, for example, must be brought into contact with the latter. However, the recording carrier must be capable of being readily removed from engagement with the intermediate carrier, as for example during pauses in the printing operation, or during apparatus malfunctions. Further, it must also be additionally assured that, following start of the transport of the recording carrier, the information on the intermediate carrier is transferred from the surface thereof to the recording carrier at the desired location. Likewise, in connection with the stopping of the recording carrier, it must be assured that the last possible line of the toner image on the intermediate carrier is properly transferred onto the recording carrier. Thus, the achievement of a satisfactory transfer of a toner image on the intermediate carrier requires that a series of conditions must be satisfied.

U.S. Pat. No. 4,131,358 (corresponding to German OS No. 2,636,326) discloses an apparatus for effecting a movement of a recording carrier to and from an intermediate carrier. In this construction, two saddle members are provided for controlling the position of the recording carrier relative to the intermediate carrier. In such construction the saddles are pivotally supported on respective axes, with such saddles being symmetrically arranged, relative to the location of the surface of the intermediate carrier at which the recording carrier is to be disposed, in close relationship to the intermediate carrier. Each saddle has a first recording carrier-engaging zone at one side of its pivotal axis, and a second carrier-engaging zone at the other side of its pivotal axis. These engaging zones are so designed that the recording carrier is engaged and adequately tensioned in each of the respective positions of the saddles.

BRIEF SUMMARY OF THE INVENTION

The present invention has as a principal objective, the production of an apparatus for transporting a recording carrier through a printing station and for effecting the desired movement of the recording carrier towards or away from the intermediate carrier at the printing station of the machine, which functionally performs the required operations and produces the desired relationship between the recording carrier and the intermediate carrier at the printing station, but which is relatively simple in construction and capable of being produced in a very cost-favorable manner.

This objective is achieved by utilizing feed means for advancing the recording carrier, which means is disposed following the printing station, as viewed in the direction of movement of the recording carrier, and which feed means includes a drive shaft forming a part of a drive installation. The latter includes an electromagnetic coupling or clutch and an electromagnetic brake, which are operable to control the transport movement of the recording carrier, in combination with suitable means, preferably a polarized solenoid, which is adapted to control the operation of means for supporting the recording carrier in cooperable printing relation with respect to the intermediate carrier, or to move the recording carrier from such operating position to an inoperative position where no printing can take place.

In a preferred embodiment of the invention, the means for supporting and guiding the recording carrier at the printing station is in the form of a yoke member adapted to engage the recording carrier at opposite sides of the printing station, which yoke member is operatively connected to the solenoid for actuation thereby. The movement of the recording carrier relative to the intermediate carrier, under control of the solenoid, advantageously can be limited by respective limiting stop members engageable with the solenoid armature to limit its movement in both directions.

Where feed means is provided, it is expedient to provide, preceding the printing station as viewed in the direction of movement of the recording carrier, a mechanical retarding member or brake which is engageable with the recording carrier to assure that the latter is constantly under tension as it passes through the printing station.

The electromagnetic brake may comprise a friction drive disk which is carried by the drive shaft for the feed means, and such drive shaft can additionally be provided with a second friction drive disk which forms the armature for an electromagnet coupling or clutch structure. The driving portion of such clutch structure can, in this case, be connected to a constantly rotating driving shaft.

Means is also provided for generating, upon the occurrence of a suitable start signal for the transport movement of the recording carrier, suitable signals for effecting an energization of the electromagnetic coupling as well as a signal for controlling the solenoid to bring the recording carrier into operative relationship with the intermediate carrier. These signals can be produced in a simple manner by means of a first clock pulse generator which is disposed on the driving shaft of the feed means, which is cooperable with a suitable scanning installation and which are adapted to be supplied therefrom to circuit means which, upon occurrence of such a start signal, selects one of the first clock pulse signals as a signal for excitation of the electromagnetic coupling, and for de-energizing the electromagnetic brake, and a second of the clock pulse signals, is used for initiating a suitable actuation of the solenoid to move that portion of the recording carrier, in the printing station, into cooperable position with respect to the intermediate carrier.

Upon the occurrence of a stop signal for halting the transport movement of the recording carrier, similar means may be provided. Thus, a second clock pulse generator expediently is carried on the drive shaft of the transport means, which generator cooperates with a second scanning installation for generating second clock pulse signals, which are supplied to second circuit means which, upon the occurrence of such a stop signal, generates from the second clock pulse signals, a first signal for so actuating the solenoid that the recording carrier is moved out of operative position or engagement with the intermediate carrier, and a second signal for initiating energization of the electromagnetic brake and the de-energization of the electromagnetic coupling.

Both the first and second circuit means can involve a simple circuit including a counter to which the clock pulse signals are supplied and which in the event of the predetermined desired count is reached, emits the signals for controlling the solenoid, the brake and the coupling structures.

In the event the recording carrier is a continuous pre-folded web, the starting and stopping of the recording carrier must be so effected that the toner images are not transferred over such fold. It is therefore expedient to so proportion the respective components, particularly with respect to the time at which the electromagnetic brake is actuated, that the recording carrier is always halted with a fold disposed at the printing station, and thus when the apparatus is idle. As a result, all stopping and starting is effected with a fold in the printing station.

BRIEF DESCRIPTION OF THE DRAWINGS

In the drawings wherein like reference characters indicate like or corresponding parts.

DETAILED DESCRIPTION

Figure 1:
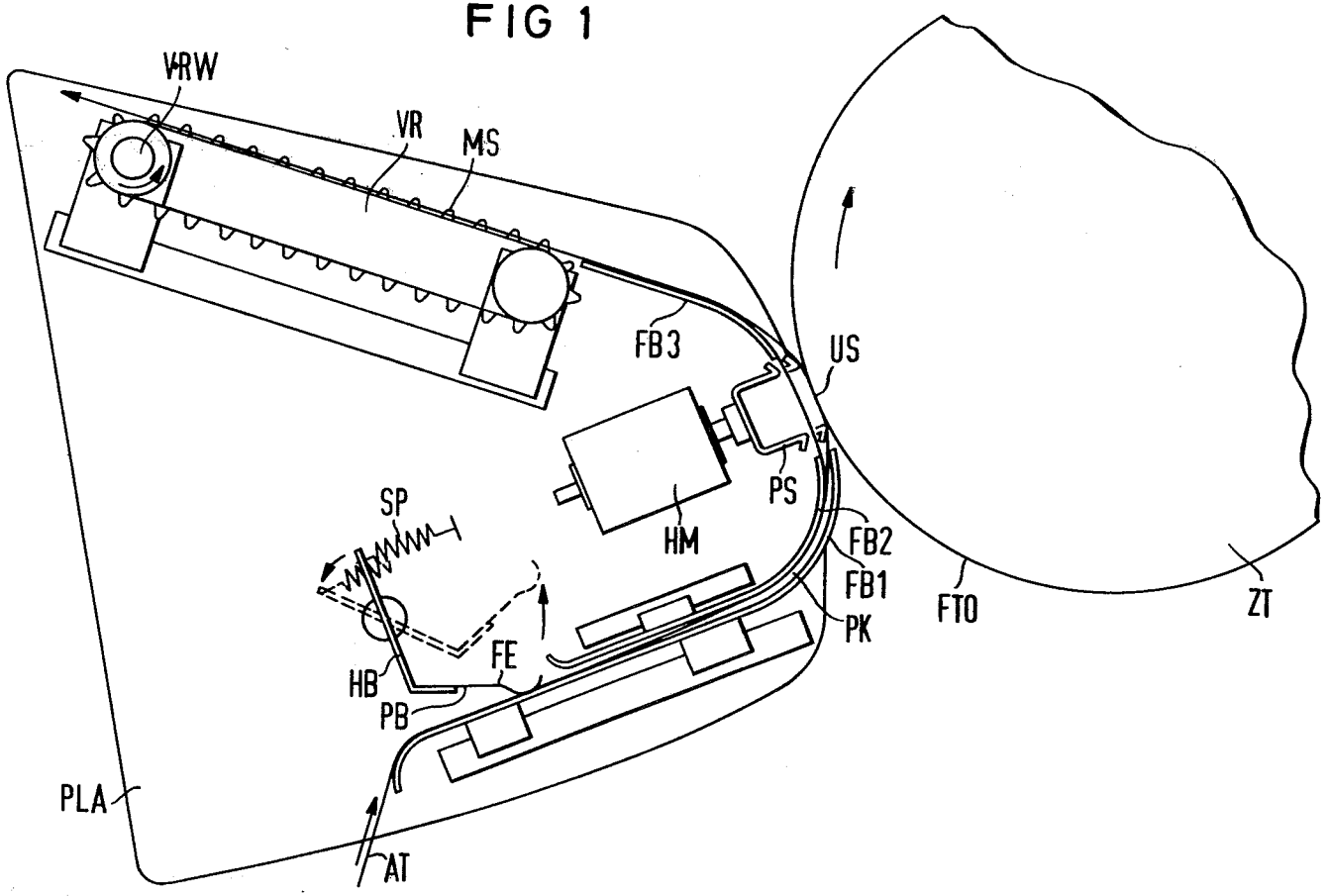
FIG. 1 illustrates a side elevational view of a transport structure in accordance with the present invention, illustrating its relationship with respect to an intermediate carrier member.

Referring to FIG. 1, the reference character ZT designates an intermediate carrier in a form of cylinder drum which is provided with a photoconductive surface FTO. Toner images, produced in known manner on the surface of the drum ZT, are transferred in a printing station US to a recording carrier AT, for example, a paper web. In this operation, the recording carrier AT is transported through the printing station US under guidance of a guide channel PK which is formed by metal guide members FB1 and FB2, located at the entrance side of the printing station US and an additional metal guide member FP3 which is disposed at the discharge side of the printing station US, by means of which guide members, the recording carrier 18 is transported to feed or advancing means indicated generally by the reference character VR. The latter in the exemplary embodiment illustrated comprises a caterpillar-type feed belt having drive pins MS disposed thereon which engage in cooperable perforations in the recording carrier AT and form a motion transmitting connection between the belt and the paper web forming the recording carrier.

Movement of the portion of the recording carrier AT disposed in the printing station US, into or out of engagement with the intermediate carrier drum ZT is effected by means adapted to support the recording carrier in either of the two desired positions. In the specific embodiment illustrated, such supporting means comprises a generally U-shaped yoke member PS having oppositely disposed portions engageable with the recording carrier at opposite sides of the printing station US, with movement of such supporting means being effected by suitable means such as a polarized solenoid, indicated generally by the reference character HM. In the embodiment illustrated, the supporting means is directly mounted on the armature of the solenoid HM whereby, in an extended position of the armature, the supporting means PS guides the recording carrier into engagement with the intermediate carrier ZT at the recording station US or, in its retracted position, permits the recording carrier to move away from the printing station US. Where only a single feed or advancing mechanism, such as the structure VR is employed, it is desirable to assure that the recording carrier is under constant tension at the location where it cooperates with the intermediate carrier ZT, as well as to suitably maintain tension during the movement of the carrier supporting means towards and away from the printing station. This is achieved in the present invention by utilizing a mechanical retarder or brake PB which is disposed preceding the printing station US, as viewed in the direction of travel of the recording carrier. The brake PB may comprise, for example, a spring member FE which is carried by a lever HB, with the latter being pivotal and engaged at its other end with a tension spring SP which biases the lever HB in a direction to maintain the spring FE in engagement with the recording carrier AT.

The individual subassemblies such as the guide channel TK, the feed belt VR, brake PB and solenoid HM may be mounted on side plates TLA, of which only one is illustrated.

Figure 2:
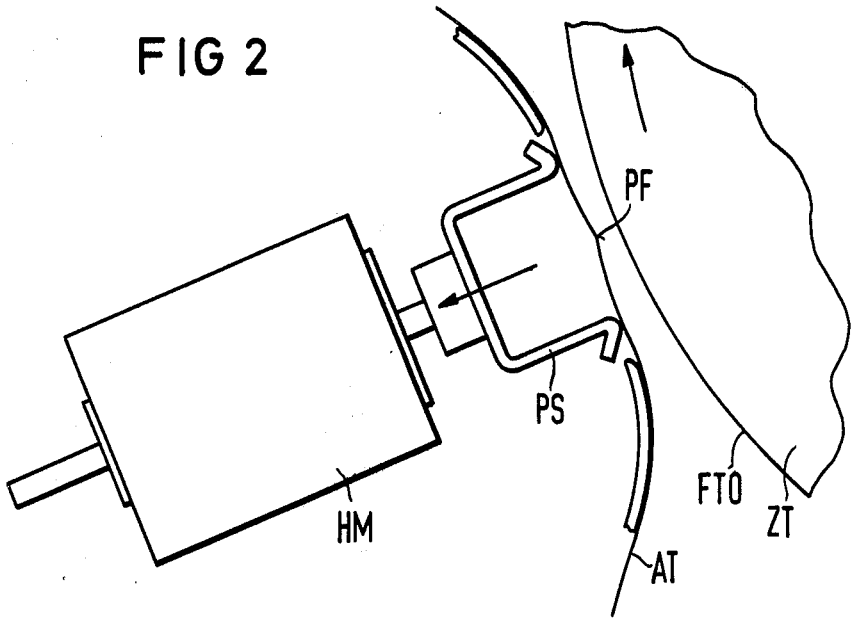
FIG. 2 is an enlarged view of the mechanism for moving the recording medium toward or away from the intermediate carrier, illustrating the same in an inoperative withdrawn position.

It will be noted, from a reference to FIG. 2, that in its retracted position, the supporting yoke PS is disposed to support the recording carrier in spaced relation with respect to the surface FTO of the intermediate carrier ZT, and which would thus represent the positioning of the structure when the recording carrier AT is stationary. If the recording carrier AT is in the form of a prefolded strip or web, the respective components are so controlled that the fold PF, representing the junction of two individual portions of the web, is disposed directly opposite the printing station and is centered between the spaced arms of the supporting yoke PS, whereby such fold PF is also centered relative to the printing station.

Figure 3:
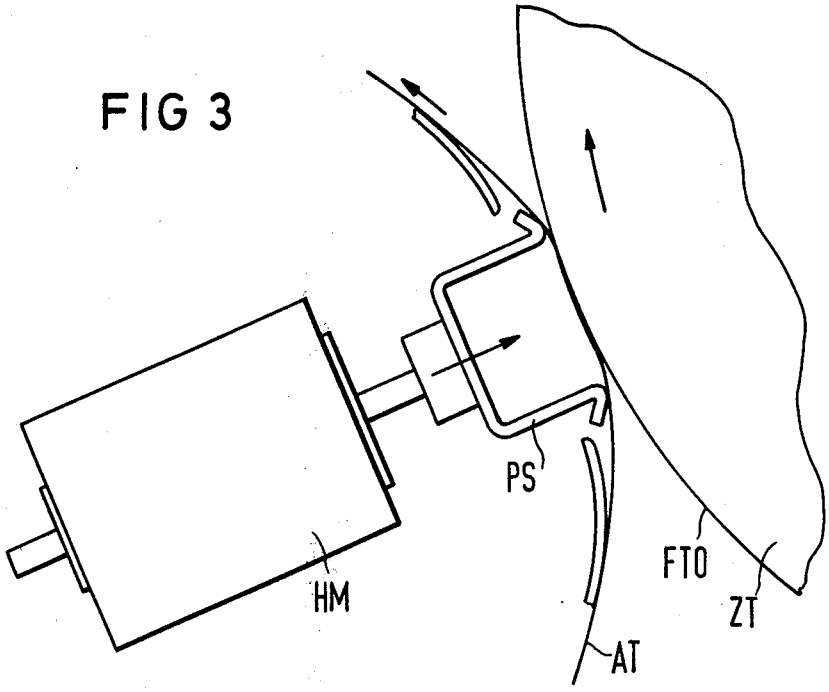
FIG. 3 is an enlarged view of the structure depicted in FIG. 2, illustrating the mechanism in actuated or operated position with the recording carrier in engagement with the intermediate carrier.

FIG. 3 illustrates the relationship of the supporting means, intermediate drum, etc. during operation of the apparatus, with the supporting means PS being disposed in extended relation closely adjacent the surface FTO of the intermediate carrier ZT, thus disposing the portion of the recording carrier spanning the spaced arms of the supporting yoke in tensioned engagement with the surface FTO of the intermediate carrier.

Figure 4:
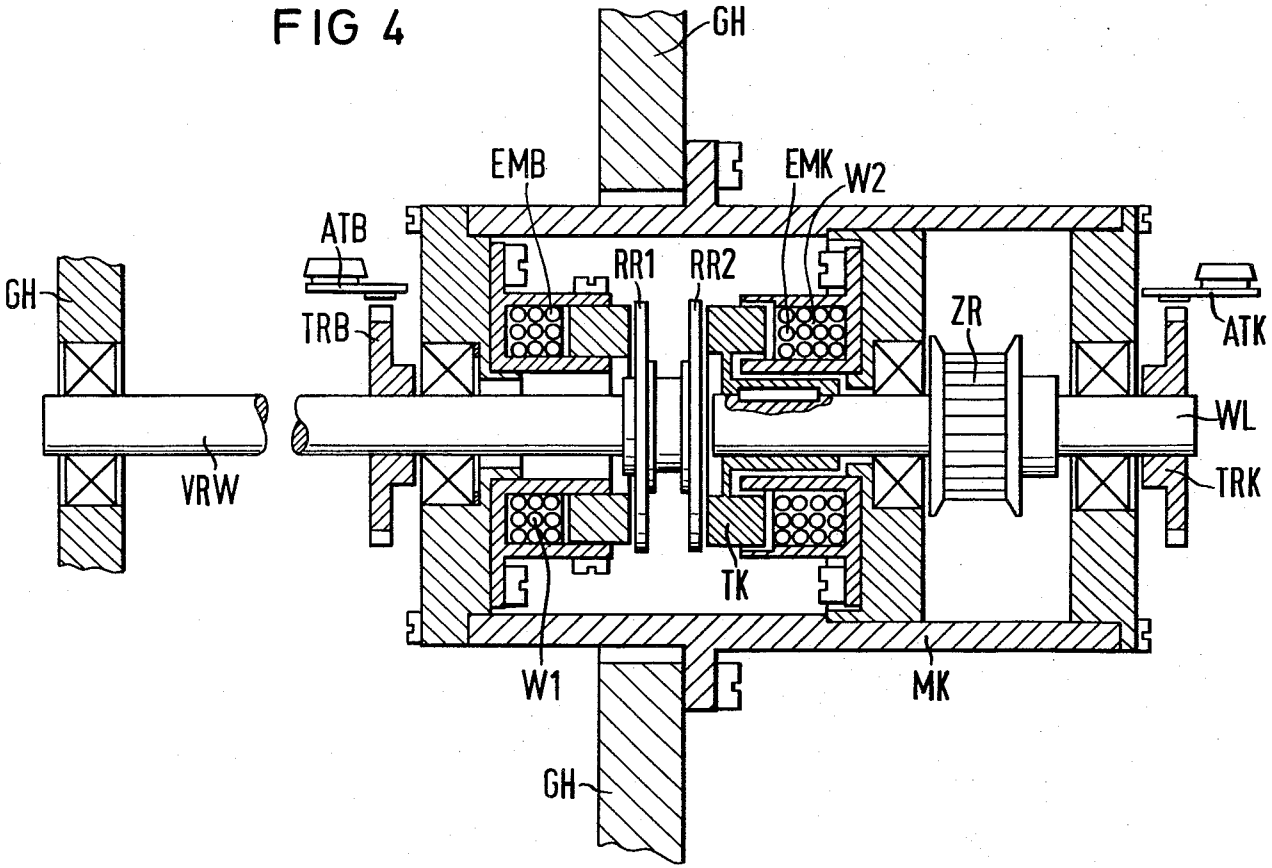
FIG. 4 is a sectional view, taken approximately on the axis of the feed drive shaft of the device, illustrating details of the clutch and braking components employed.

FIG. 4 illustrates the construction of the drive mechanism for the recording carrier, and includes the electromagnetic brake structure and the driving structure. These structures are arranged in a housing, indicated generally by the reference character MK, which is adapted to be suitably secured, as for example by bolts or screws to a portion of the frame or housing GH of the printing or copying apparatus. As illustrated, the adjacent end of the drive shaft VRW associated with the feed means VR is mounted in the housing MK. In this construction the feed means VR, not illustrated, would be connected to an intermediate portion of the shaft VRW.

The electromagnetic brake EMB and the electromagnetic coupling EMK are disposed within housing MK, with the brake EMB being rigidly connected with the housing and disposed concentrically with the adjacent end portion of the shaft VRW. Rigidly carried by the drive shaft VRW is a first friction disk RR1 which is cooperable with the electromagnetic brake EMB, which is provided with an energizing winding W1.

The electromagnetic brake operates in a known manner, whereby upon the passage of a current through the winding W1 the frictional disk RR1 is drawn to the electromagnet brake MB and the drive shaft VRW is thus brought to a standstill.

Also, rigidly carried by the drive shaft VRW at the adjacent end thereof is a second frictional disk RR2 which is cooperable with the electromagnetic coupling EMK. The latter likewise is constructed in a known manner. The coupling has a movable member TK which is fixedly connected with a constantly rotating driving shaft WL, and further includes a winding W2 which is carried by the housing MK. Upon the passage of current through the winding W2 of the electromagnetic coupling EMK, the frictional disk RR2 is drawn to the member TK and the torque of constantly rotating shaft WL is thus transmitted to the friction disk RR2 and thereby to the drive shaft VRW. The shaft WL is adapted to be operatively connected to a suitable motor or the like by means of a toothed belt pulley ZR and cooperable belt.

Operation of the device is as follows:

Considering first the starting operation from a standstill, and assuming that the recording carrier AT is of the prefolded type, the fold PF, as illustrated in FIG. 2, is disposed in idle position directly opposite the printing station. The recording carrier AT must be so brought into movement that the printing information carried on the surface FTO of the drum ZT, subsequent to acceleration of the recording carrier, is disposed in desired registry with the recording carrier.

As previously mentioned, the feed means VR, comprising caterpillar-feed belts, only one of which is shown, is disposed in a following position relative to the printing station US as viewed in feed direction and are in fixed idle position by means of the elegtromagnetic brake EMB. With a start command, the electromagnetic brake EMB is de-energized and at the same time the electromagnetic coupling EMK is energized. After a brief travel of the recording carrier, for example ½ inch, the latter is accelerated to its final speed. The recording carrier AT then is travelling at the same continuous rate of speed as the surface FTO of the intermediate carrier ZT and thus can be brought into printing association with the latter to assure a satisfactory printing operation. At this point, only a distance of, for example 5/12 inch remains available to dispose the recording carrier AT on the surface FTO of the intermediate carrier ZT and to stabilize the recording carrier AT. The latter is initially spaced approximately 5 mm from the surface FTO of the intermediate carrier ZT, and the movement of the recording carrier to the surface FTO is effected by means of the polarized solenoid HM. Upon energization of the latter, the yoke member PS guides the recording carrier AT into proximity with the surface FTO of the intermediate carriers ZT and by means of electrostatic forces, the recording carrier AT is disposed against the surface FTO of the intermediate carrier ZT over a range of 10 mm in the feed direction. The solenoid HM is polarized and is moved perpendicularly to the surface of the intermediate carrier and remains energized for a time sufficient to drive the armature into engagement with the adjacent limiting stop thereof. In this position, through its permanent magnet retaining force, it is operative to retain the yoke PS in position to hold the recording carrier in operative position during the printing operation.

Movement of the recording carrier AT proceeds as follows. The recording carrier AT moves during the printing operation with a continuous rate of speed through the printing station US and, dependent upon the need therefor can be stopped at every fold PF of the recording carrier. When the last-possible line has been printed, the solenoid HM is energized to move the guide yoke PS and thereby the intermediate carrier ZT away from the surface of the intermediate carrier Z2 with the guide yoke PS moving perpendicularly away from the surface FTO toward its second opposite armature limiting stop. When the latter has been reached, the guide yoke PS is in its remote position, in which it is retained by the permanent magnetic retaining force of the armature limiting stop. While the guide yoke is being retracted by the solenoid HM, the feed caterpillar belts VR advance the recording carrier AT thereby stripping it from the surface FTO of the intermediate carrier ZT, as the portion of the recording carrier AT at the entry side of the printing station UF is engaged with the retarding brake PB and thus draws the recording carrier AT to the remotely position guide yoke PF. The electromagnetic brake EMB is energized and the electromagnetic coupling EMK de-energized, only when the solenoid HM has attained its remote position, at the desired time. The electromagnetic brake delays the feed caterpillar belts VR over a distance of a predetermined distance, i.e. ½ inch to the desired standstill, when a fold PF of the recording carrier AT is again disposed in the desired start position at the printing station US.

Figure 5:
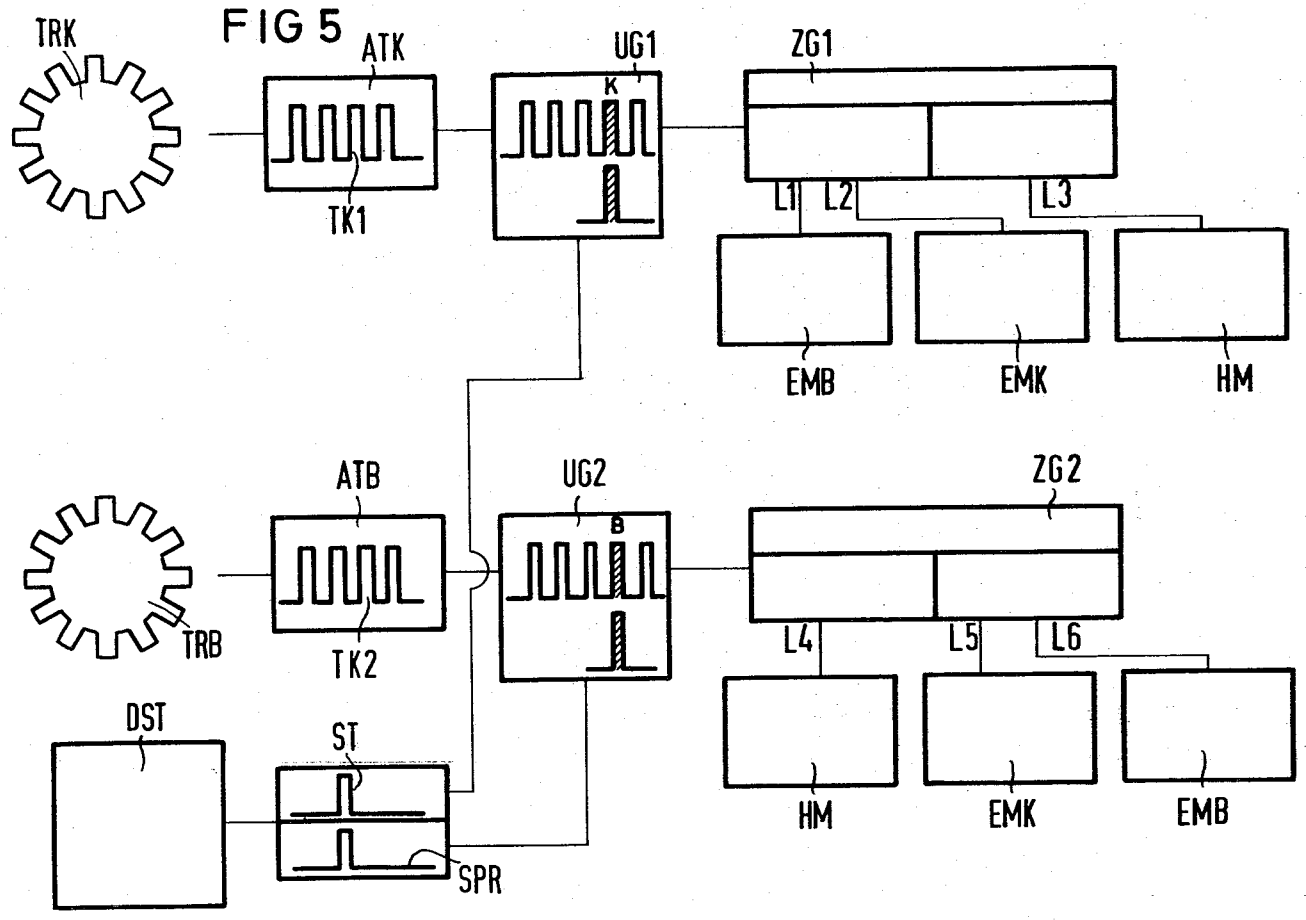
FIG. 5 illustrates a circuit arrangement in accordance with the invention, illustrated in block form.

The above-described operations are achieved in conjunction with a clock pulse control illustrated in FIG. 5. Though clock pulse wheels TRK and TRB are provided which, as illustrated in FIG. 4, are disposed respectively on the free ends of the continuously rotating shaft WL and the shaft VRW, respectively. The pulse wheel TRK is adapted to be scanned by a first scanning installation ATK, while the second clock pulse TRB is adapted to be scanned by a second similar scanning installation ATB. The pulse wheels may be of similar construction, as illustrated, and may consist of a slotted disk which is cooperable with the associated scanning installation ATK or ATB, both of which may be constructed in a known manner. Thus, the first clock pulse wheel TRK is continuously rotating while the second TRB is rotating only during rotational drive.

The clock pulse wheels TRK and TRB and the scanning installations ATK and ATB are merely symbolically illustrated in FIG. 5. The first scanning installation ATK generates a series of first clock pulses TK1 and in like manner the scanning installation ATB generates second clock pulses TK2. Assuming that the apparatus is at a standstill, and it is desired to initiate operation thereof, a start pulse ST is generated in a printer control device DST, whereupon the first clock pulses TK1 are conducted through an AND circuit UG1 to a first counter installation ZG1. The first clock pulse which is conducted to the first counter installation ZG1 is designated by the reference character K in FIG. 5. The first counter installation ZG1 counts upwardly and when it reaches a first predetermined counter-reading a signal is supplied to lines L1 and L2. The line L1 conducts such signal to the brake EMB and the line L2 conducts the signal to the coupling EMK, with the signal to the electromagnet brake EMB effecting a de-energization thereof and the signal supplied to the electromagnetic coupling EMK energizing the same.

The drive shaft VRW is thereby coupled with the constantly rotating shaft WL. When the first counter installation EG1 reaches a second counter reading, a signal is then supplied to line L3 which in turn supplies such signals to the solenoid HM causing the latter to move the recording carrier AT to the intermediate carrier ZT. The first counter-reading can be derived, for example, when 182 clock pulses TK1 are counted and the second counter-reading when 84 clock pulses are counted. The magnitude of the second counter-reading is dependent upon the distance of the writing location on the intermediate carrier ZT from the transfer printing station US. In other words, the recording carrier AT must be moved to the intermediate carrier ZT when the printing information, applied to the intermediate carrier Z2 at the writing location, has reached the printing station US. To stop the forward movement of the recording carrier, a stop signal is generated by the printer control device DST.

Following that occurrence of the stop pulse SPR, the second clock pulse signals TK2 are supplied through an AND circuit UG2, to a second counter installation ZG2. The clock pulses from which the second clock pulse TK2 are supplied to a second counter installation ZG2, and is designated by the reference character B. The second counter installation ZG2, upon reaching a first counter reading supplies a signal over line L4 to the solenoid HM, whereby the latter is moved in a direction away from the intermediate carriers Z2, whereby the recording carrier 18 is separated from the intermediate carrier. Upon reaching a second counter reading, the counter ZG2 supplies a signal over respective lines L5 and L6 with the line L5 supplying such signal to the electromagnetic coupling EMK to de-energize the same, while the signal is conducted over line L6 to the electromagnetic brake EMB which is thereupon energized. Again, the first counter reading can, for example, be 82 clock pulses TK2 and the second counter reading 84 clock pulses TK2.

By use of the two clock pulse wheels TRK and TRB, in combination with two scanning installations ATK and ATB, the initiation of the start operation and that of braking operation may be achieved independently of one another. Consequently, tolerances existing in the coupling operation, or in the braking operation, do not produce a cumulative effect in the event of a plurality of coupling and braking operations. High precision in the angle-position operation is thereby achieved.

It will be apparent that an apparatus in accordance with the present invention has a number of advantages. The combination of magnetic coupling, magnetic brake and the solenoid, permit such a rapid acceleration and delay of the recording carrier that the stopping, separating movement of the recording carrier from the intermediate carrier ZT, the starting and initiating of movement toward the intermediate carrier ZT are possible in a range of, for example, 1 inch.

The electromagnetic coupling and the electromagnetic brake are housed in a dust-proof housing MK which thereby protect the soil-sensitive frictional surfaces thereof. A high degree of positioning accuracy thereby can be achieved for a long period of time. Due to the fact that the recording carrier, following stopping thereof, is immediately in its initial waiting position for the next start, and it need be moved only in the direction necessary for the printing operation. Thus, only a suitable feed or advancing mechanism, for example the caterpillar belt structures is required following the printing station. As a result, the entire recording carrier transport construction can be fabricated very cheaply. As only a single feed mechanism VR is required, a simple and ready insertion of the recording carrier can be achieved. Prior to such insertion, the mechanical brake PB is pivoted away from the guide surface FB1, as illustrated in FIG. 1, by means of a suitable simple handle structure. The recording carrier AT may then be inserted into the recording carrier channel PK and extended into engagement with the caterpillar belt structure VR with which it is engaged for transport movement.

Although I have described my invention by reference to particular illustrative embodiments, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim as my invention:

1. An apparatus for transporting a recording carrier through a printing station and for moving the recording carrier to or from an intermediate carrier at the printing station of a printing or copying apparatus, in which the toner images of the characters to be printed are disposed on the intermediate carrier and transferred therefrom to the recording carrier, comprising feed means (VR), engageable with the recording carrier following the printing station as viewed in the feed direction of the recording carrier, and including an actuating drive shaft (VRW), a drive installation (MK) cooperable with said drive shaft (VRW) for controlling the operation thereof and including an electromagnetic coupling (EMK) and an electromagnetic brake (EMB) for respectively selectively driving or braking said drive shaft and therewith the recording carrier, movable means (PS) engageable with the recording carrier at the printing station operable in one position for supporting the recording carrier in operative printing position relative to said intermediate carrier or in another position to support the recording carrier in a nonoperating position relative to said intermediate carrier, and a polarized solenoid connected to said moveable means and cooperable with said recording carrier supporting means for moving the latter to or from either of said positions and control circuit means connected to said feed means and to said polarized solenoid.

2. An apparatus according to claim 1, wherein said supporting means at said printing station is provided with guide means engageable with said recording carrier at opposite sides of said printing station, said solenoid having armature-limiting stops determining the amount of travel of said supporting means.

3. An apparatus according to claim 1, comprising mechanical retarding means engageable with said recording carrier, preceding said printing station, as viewed in the direction of movement of the recording carrier.

4. An apparatus according to claim 1, comprising a friction disk, fixedly arranged on the drive shaft of said feed means which forms the armature of said electromagnetic brake.

5. An apparatus according to claim 1, comprising a second friction disk arranged at the end of said drive shaft, which forms the armature of said electromagnetic coupling, and which is carried by a constantly rotating drive shaft.

6. An apparatus according to claim 5, comprising a first clock wheel disposed on said constant drive shaft, which pulse wheel is cooperable with a scanning installation for generating clock pulse signals, and first circuit means responsive, upon occurrence of a start signal for the feed movement of the recording carrier, for generating a signal for energizing said electromagnetic coupling, for deenergizing said electromagnetic brake, and for subsequently generating a signal for energizing said solenoid.

7. An apparatus according to claim 5, comprising a second clock pulse wheel arranged on the drive shaft of said feed means, which is cooperable with a second scanning installation for generating second clock signals, and second circuit means responsive upon occurrence of a stop signal for halting the feed movement of the recording carrier for generating a signal for energizing said electromagnetic brake, for deenergizing said electromagnet coupling, and for generating a signal for deenergizing said solenoid.

8. An apparatus according to claim 7, wherein said first circuit means comprises counter means for generating the signal for energizing said electromagnet coupling, for deenergizing said electromagnet brake, and energizing said solenoid, and said second circuit means comprises counter means for generating the signal for energizing said electromagnet coupling, for deenergizing said electromagnet brake and for generating a signal for energizing said solenoid.

9. An apparatus according to claim 8, wherein prefolding carriers are employed, and said second circuit means is constructed to provide said signal for energizing said electromagnetic brake to stop the movement of the recording carrier when a fold between two adjacent recording carriers is disposed at the printing station.

* * * * *